US005180286A

United States Patent [19]

Dean

[11] Patent Number: 5,180,286

[45] Date of Patent: Jan. 19, 1993

[54] PROPELLER ASSEMBLY

[76] Inventor: Peter E. Dean, 111 Hillside Dr., Monroe, Ga. 30655

[21] Appl. No.: 587,955

[22] Filed: Sep. 25, 1990

[51] Int. Cl.[5] ..... B63H 1/20

[52] U.S. Cl. ..... 416/220 A; 416/93 A; 416/219 A; 29/889.6

[58] Field of Search ..... 416/93 A, 204 R, 219 A, 416/220 A, 244 B; 29/889.6, 889.61; 72/254

[56] References Cited

U.S. PATENT DOCUMENTS

| | | | |
|---|---|---|---|
| 123,274 | 1/1872 | McCay . | |
| 335,640 | 2/1886 | Simmons . | |
| 390,615 | 10/1888 | Nye . | |
| 548,655 | 10/1895 | Pagan . | |
| 612,598 | 10/1898 | Wanless . | |
| 752,670 | 2/1904 | Hamilton . | |
| 1,363,660 | 12/1920 | Fleur . | |
| 2,781,998 | 2/1957 | Barr . | |
| 3,021,003 | 2/1962 | Bluck | 29/889.7 |
| 3,071,195 | 1/1963 | Osmaston . | |
| 3,132,698 | 2/1964 | Lesher . | |
| 3,246,699 | 4/1966 | Jocz . | |
| 3,412,611 | 11/1968 | Eccles et al. | 29/889.7 |
| 3,764,228 | 10/1973 | Shook . | |
| 3,876,331 | 4/1975 | Denherder et al. . | |
| 4,417,852 | 11/1983 | Costabile et al. . | |
| 4,451,205 | 5/1984 | Honda et al. . | |
| 4,483,661 | 11/1984 | Manharth et al. . | |
| 4,566,855 | 1/1986 | Costabile et al. | 416/134 R |
| 4,756,265 | 7/1988 | Lane | 114/57 |
| 4,767,278 | 8/1988 | Enderlein, Jr. | 416/241 B |
| 4,930,987 | 6/1990 | Sthal . | |

*Primary Examiner*—Edward K. Look
*Assistant Examiner*—Michael S. Lee
*Attorney, Agent, or Firm*—Beveridge, DeGrandi & Weilacher

[57] ABSTRACT

A propeller assembly which includes a barrel with replaceable blade assemblies secured within slots formed in the exterior of the barrel. The slots include a first slot section and a second slot section with the first slot section extending radially deeper than the second slot section. The blade assemblies include L-shaped locking members which slide within the slots formed within the barrel. The shorter leg of the locking members are secured within the deeper first slot sections while the longer leg extends longitudinally within the second slot section. The locking member preferably includes a dovetail cross-section member fixing the shorter leg member to the barrel so as to prevent both longitudinal, torsional and radial movement of the blade assemblies. The barrel is preferably formed of an aluminum material or, more precisely, an aluminum alloy having 60% to 95% essentially pure aluminum while the blade assemblies and securement members are formed of stainless steel. The barrel is preferably formed in an extrusion process with subsequent minor machining work. The barrel includes exhaust conduits as well as inner and outer concentric shell joined by spoke members which extend in a forward to aft direction. Securement of the leg members within the first slot section is achieved through use of a stud and nut assembly, a threaded bolt or a spring biased pin which can be disengaged upon insertion of a tool.

40 Claims, 5 Drawing Sheets

PROPELLER ASSEMBLY

BACKGROUND OF THE INVENTION

1. Field of the Invention

This invention relates to a propeller assembly and a method for manufacturing propeller assemblies. More particularly, this invention relates to a through-the-barrel exhaust marine propeller assembly with replaceable blades.

2. Background Discussion

Since about 1850, marine propellers have been utilized in the propulsion of ships. The marine propellers traditionally have been cast or forged of metal with the hub and blades formed as a single unitary part.

One or more of the propeller blades in a unitary propeller assembly, especially those used in a marine environment, often become damaged so as to require replacement of the entire propeller assembly. When a marine propeller strikes an object below the surface of the water one or more of the blades may become bent or chipped causing a reduction in the efficiency of propulsion and, possibly, degradation to the driving means due to imbalance of the blades. The requirement for replacement of the entire propeller assembly especially for those situations where only a single blade has been slightly damaged is very frustrating to boat owners, especially in view of the expense associated with the purchase of a unitary propeller assembly.

In an attempt to avoid the problems associated with replacement of entire propeller assemblies, attempts have been made to provide a propeller assembly with replaceable blades. U.S. Pat. Nos. 123,274; 752,670; 1,363,660 and 3,132,698 are illustrative of such attempts to provide a propeller with replaceable blades. These references also reveal the use of dovetail connections between the hub and blades.

The prior art attempts to provide replaceable propeller blades suffer from numerous drawbacks such as:

1. insufficient support against distortion of the blade upon contact with an object;

2. complicated methods of attachment of the blade to the hub which increased expense and, in some instances, assembly/disassembly time;

3. susceptibility of the attachment means to corrosion (especially in salt water environments) which increases the time for disassembly;

4. the likelihood of the hub becoming damaged or worn upon one or more of the blades becoming damaged.

5. the inability to protect the driving means by absorbing or dampening the shocks which originate with a propeller blade upon contact with an object; and 6. the inability to avoid harmonic frequencies and vibrations being passed from the driving motor to the propeller assembly.

The aforementioned U.S. Pat. No. 3,132,698 illustrates some of the problems associated with prior art propeller blade assemblies. U.S. Pat. No. 3,132,698 reveals a propeller blade with a dovetail that is designed for sliding into a slot. The connection between the blade and the hub is such that the blade, upon contact with an object, would have a tendency to twist within the slot. Such twisting would damage the flanges forming the dovetail slot or, in some instances, cause sufficient wear in the dovetail slot or dovetail to cause propeller wobbling or imbalance. Furthermore, such an assembly as that in U.S. Pat. No. 3,132,698 would require, especially for larger horse power motors, that the hub be formed of a high strength material which is not susceptible to distortion or wear. In addition to the expense associated with a high strength material such as stainless steel, the high strength material is also likely to create a relatively heavy hub assembly which can cause increased wear in the driving means.

The aforementioned U.S. Pat. No. 1,363,660 features a plurality of radially extending screws fastening the propeller blade to the hub. Such a manner of attachment is likely to avoid blade distortion, but only at the expense of an increase in the time for assembly and disassembly. The manner of attachment in U.S. Pat. No. 1,363,660 is also likely to increase the chance of corrosion or rusting causing difficulty in disassembly.

U.S. Pat. Nos. 3,764,228; 3,876,331; 4,417,852 and 4,930,987 illustrate marine propeller assemblies having replaceable blades and exhaust ports through the hub. U.S. Pat. No. 3,876,331 discloses a structure which avoids the use of threaded couplings so as to avoid freeze up problems. The attachment method of U.S. Pat. No. 3,876,331 presents a relatively large number of components which are susceptible to breaking or loss. In addition, securement of the blades with collars or rings present the problem of low blade impact survivability or durability due to factors such as the attachment being away from the center of the blade. U.S. Pat. Nos. 3,764,228 and 4,930,987 also rely on ring or collar connections and thus suffer from the same deficiencies in attachment durability or survivability.

The state of the prior art for such exhaust through propeller assemblies is also such that the hubs are formed of casted stainless steel to achieve sufficient strength. Stainless steel hubs are relatively heavy and have a tendency to quickly wear out the moving parts of the driving means. Furthermore, the requirement for drafts in the casting technique reduces the maximum exhaust gas passageway size resulting in a drop in propulsion efficiency. The exhaust passageway size limitations imposed by draft angle requirements in the casting process also restricts the range of suitable motor sizes which can be used with the casted blade assembly.

The aforementioned U.S. Pat. No. 4,417,857 features a hub which is placed in direct contact with the spline of the driving means. This arrangement results in the forces which develop during blade impact being passed directly to the driving shaft and the remainder of the driving means. In addition, the driving mean's vibrations and harmonic frequencies are not absorbed and therefore are passed to the propeller blade so as to reduce propulsion efficiency.

The prior art requirement for the hubs to be formed in a casting process results in high manufacturing expense in materials, time consumption, labor and extensive finishing requirement.

SUMMARY OF THE INVENTION

The present invention features a propeller assembly and a method for manufacturing propeller assemblies. A preferred embodiment of the present invention features a propeller assembly with a barrel having a forward and aft end. Attached to the barrel are a plurality of blade assemblies. Each blade assembly includes a blade, a base section extending out away from the root of the blade, and a locking member. In a preferred embodiment, the locking member includes a dovetail extension, extending in a forward to aft direction, as well as a leg member extending off of one end of the dovetail extension so as to form an L shaped locking member.

On the exterior of the barrel, there are formed a plurality of dovetail slots (e.g., 2 or more) which extend in a forward to aft direction preferably for more than 80% but less than 95% of the length of the barrel. The dovetail slots formed in the barrel include a first slot section formed at one end of the barrel and a second slot section which extends from the first slot section towards the opposite end of the barrel. The multi-depth slot formed in the exterior of the barrel is dimensioned so as to receive the locking member with the leg member positioned in the first slot section and the dovetail extension retained within the second slot section. The dovetail configuration of the slot and extension member (and leg member in a preferred embodiment) act to releasably lock the blade assembly from moving in a radial direction with respect to the barrel.

The propeller assembly of the present invention also includes means for releasably securing the locking member to the barrel so as to prevent longitudinal movement of the locking member with respect to the barrel. In one embodiment, the securing means includes a stud fixed within the barrel so as to extend longitudinally into or through the first slot section. The leg member of the blade assembly includes a passageway therethrough which is dimensioned to receive the stud member. Preferably, the stud member is of a length which extends completely through the leg member such that a nut can fix the locking member into position within the slot formed in the barrel.

Alternatively, the securement means can include a threaded bore formed in the barrel, a passageway through the leg member, and a threaded bolt which releasably fixes the locking member into position.

In a preferred embodiment, the securement means is formed of a material not susceptible to rusting such as stainless steel. Thus, the securement means can include a stainless steel stud extending through a stainless steel locking member and a stainless steel nut such that, when the stainless steel nut is threaded in locking position, the stainless steel stud, resting against the stainless steel face of the leg member, avoids any electlolytic action which can cause corrosion or electrolysis. A similar result can be had with the use of a stainless steel bolt extending through a stainless steel locking member into a threaded bore within the barrel.

Preferably the barrel is formed of an aluminum material while the propeller blades are formed of stainless steel. The use of an aluminum barrel allows for a drastic reduction in the weight as compared to prior art propeller assemblies relying on stainless steel for the hub. In fact, with the use of an aluminum barrel it is possible in some instances to reduce the weight of the entire propeller assembly by more than 50%. This reduction in weight results in an increase in the life of the engine's moving parts especially the engine's drive shaft bearing assembly which has to compensate for the cantilever type arrangement of the propeller assembly attached to the end of the drive shaft.

The securement means for the present invention which includes the dovetail slot with first and second slot sections and the securement member extending through the leg member, provides an added degree of structural support which enables the use of materials other than stainless steel for the hub. For example, the ability of the securement means of the present invention to avoid distortion of the locking member while within the dovetail slot is enhanced with the connection and positioning of the leg member to the barrel. The added depth of the first slot section in combination with the leg member and securement member is particularly useful in providing added stability against the propeller blade or blades becoming disengaged from their operational position during impact. In fact, preliminary experimentation suggest that the blade assembly locking arrangement of the present invention provides essentially the same propeller blade distortion avoidance as a one piece casting.

The design of the present invention also enables one to manufacture the barrel in an extrusion process. The ability to manufacture the barrels in an extrusion process provides many advantages over the casting methods relied upon in the prior art. In addition to the reduction in labor cost, material output, and finishing requirements, the extrusion process allows for high accuracy in the dimensions which results in better propeller assembly performance. Furthermore, by simple replacement of a die in the extrusion process it is possible to easily change the resultant barrel design from one form to another. The ability to manufacture the barrel in an extrusion process also allows for more efficient exhaust conduit design. By extruding the barrel in a continuous process there is avoided the requirement for draft angles utilized in prior art castings. In fact, with the enhanced dimension control and avoidance of draft angles provided for in the present invention's apparatus design and method of manufacture, it is estimated that a 30–50% increase in the size of the exhaust passageway can be achieved with respect to comparable sized prior art propeller assemblies. Accordingly, the propeller assembly of the present invention can be used with a greater range of motor sizes than similar sized prior art assemblies.

The barrel of the present invention preferably includes a cylindrical outer shell and a cylindrical inner shell arranged in concentric fashion. Extending between the inner and outer shells are a plurality of spoke members which extend in a forward to aft direction. The interior of the outer shell and the exterior of the inner shell together with the sides of adjacent spoke members define the exhaust conduits. In utilizing the extrusion process, the spoke members are integrally formed with the inner and outer shell through the appropriate positioning of blocks in the extrusion die. The number of spoke members can be easily modified to achieve the desired barrel design characteristics.

In a preferred embodiment of the invention, the base section of the propeller blade assemblies include a flange extension which shares a common curvature with the exterior of the barrel. The flange extension extends on both sides of the root of the blade so as to cover $(1/n \times 2\pi r)$ of the barrels circumference with n equaling the number of propeller blades and r equaling the radius of the barrel. In this way, when the locking members are fixed in position with respect to the barrel the flange extensions have their common sides in contact so as to provide added stability. In one embodiment of the invention, the adjacent edges of the blade flange extensions are welded together or permanently fixed in an alternative manner so as to form a continuous blade base ring. In an alternate embodiment a single unitary blade assembly is formed by casting with a plurality of blades. The single propeller assembly features a common base section formed in ring-like fashion and a plurality of equally spaced blades extending from one side and a plurality of locking members extending inwardly off the interior surface of the ring-like base. The permanent fixture of all propeller blades to one another or the formation of a unitary blade assembly casting is particularly suited for users who often vary the pitch angle for all blades based on intended use. With the blades welded or permanently fixed together at their base or formed as a unitary casted member with the base, it is possible to simply remove the nut or securement device retaining the locking member of each blade and slide the blades off of the hub whereupon a new blade assembly can be slid into position and secured.

The present invention also contemplates a propeller assembly designed for individual replacement of blade through placement of blade flange extensions in contact but not in securement with one another. The ability to replace individual blades would be most appropriate for propeller assemblies being utilized with relatively smaller sized engines (e.g., 25 to 400 horse power motors) wherein the additional securement through permanent affixation of the blade flange extensions is not required.

The present invention also contemplates the use of a rubber clutch or rubber bushing positioned within the interior of the barrel. Preferably, one end of the barrel includes an inwardly extending flange having a free end which defines an aperture and its other end secured to the inner shell of the barrel. This inwardly extending flange helps prevent the rubber bushing from longitudinal movement and provides a surface for attaching the drive spindle to the hub in a manner conventional in the art (e.g., a large diameter nut with cotter pin extending through to the nut and drive spindle.) The utilization of the rubber clutch or bearing plays an important role in the reliability of the engine and the life of the propeller. When the propeller assembly is subjected to severe impact, the clutch is designed to slip but still remain in the drive configuration. Also, the clutch is designed to counteract and absorb any vibration transferred from the propellers upon minor contact or damage with an object. The rubber clutch also achieves the important function of absorbing the engine's rotation harmonics in a fashion similar to the harmonic balances used at the front of automobile engines.

The present invention, with its ability to utilize an aluminum barrel, allows for the use of a rubber material which is softer than the rubber material utilized with prior art stainless steel hubs. The prior art stainless steel hubs typically requie a rubber having a durometer value of 80 to 90 or more. The present invention, on the other hand, preferably utilizes a rubber bearing having a hardness value of less than 80 durometer and more preferably of about 70 to 75 durometer for positionment within the aluminum barrel. The reliance of the prior art on a harder rubber bushing is based on the use of stainless steel barrels which require a much harder rubber due to the stainless steel material's inability to provide a high drive friction value on the rubber clutch.

The internal bore of a stainless steel barrel is essentially non porous. The rubber clutch is inserted within the internal bore by compressing the rubber clutch at about 10,000 to 15,000 psi and sliding it along a funnel and into the bore. A high durometer value of about 80–90 is required for use with the stainless steel barrels as the rubber clutch must be pressed against the smoother stainless steel bore to a greater extent.

The introduction of an aluminum barrel provides for the advantageous use of a softer rubber (70–75 durometer). The outward force against the bore in the aluminum material need not be as great in view of the more porous exterior. In fact, a 70 durometer rubber clutch squeezed into the bore and in contact with the more porous aluminum surface is believed to better avoid slippage of the propeller assembly about the rubber clutch's exterior than an equivalent sized 85 durometer clutch in a stainless steel hub. Moreover, the use of a softer rubber in an aluminum barrel with stainless steel blades, provides an arrangement which is lower in vibrations and harmonic frequencies so as to provide a smoother operating propeller assembly than that of a stainless steel barrel with stainless steel blade propeller assemblies.

The present invention also contemplates the use of a spring loaded pin as part of the securement means and in place of the stud or bolt. Preferably, a vertical hole would extend into the leg member wherein a spring bar pin is retained. A throug-hole would be formed in the barrel such that when the locking member is inserted within the dovetail slot, the pin member would snap down into the hole formed in the barrel within the first slot section. Removal of the blade assembly could be achieved by sticking a needle or similar object in the through-hole to disengage the pin.

As previously discussed, the present invention includes a method for manufacturing propeller assemblies which includes a step of extruding a barrel so as to have an internal bore for receiving driving means, an inner shell, exhaust conduits, an outer shell, and a plurality of locking slots formed in a forward to aft direction along the outer shell. The manufacturing method also includes the formation of a plurality of blade assemblies with locking members designed for reception within the locking slots formed within the outer shells. The method further contemplates the formation of the slots and locking members in a complementary dovetailed arrangement. The method further includes the machining (e.g. electric discharge machining or milling) of a plurality of first slot sections as well as a threaded section on the interior end of the inner shell.

In view of the recent modifications in propeller driving means concerning the use of twin motors with transmissions which allow for both a clockwise and counter clockwise rotation of the driving shaft, the present invention provides a unique propeller blade design which includes a left hand pitch ranging in value from a constant pitch value of 13 to 28 inches (or more preferably 17–25 inches) or a non-constant progressive pitch design with the pitch value progressing from a minimum of about 13 to a maximum of about 28 (or more preferably 17–25 inches) at between about a 1 inch progressive to a 4 inch progressive pitch. The rake of the preferred left hand propeller blade lies within a range of about 14° to 18° with the preferred value being 16° to 17° in rake. The left hand blade is preferably formed of aluminum, stainless steel or plastic. The stainless steel embodiment is particularly suited for use in the above described propeller assembly.

From the foregoing, it is evident that the present invention provides a solution to the aforementioned problems associated with the prior art. The present invention provides a barrel which can be formed of aluminum due to its unique design and the manner of securing the propeller blades to the hub. The ability to form the barrel of aluminum significantly reduces the weight of the propeller assembly so as to prolong the life of the driving means. The unique securement arrangement of the present invention prevents distortion of the propeller blades at a level similar to that of a single unitary casted propeller assembly. The ability to extrude the present invention is advantageous from a manufacturers standpoint and allows for the formation of a more efficient exhaust conduit. Furthermore, the securement arrangement of the present invention, not only provides a strong structural connection, but also is easy to assemble and disassemble and is not as susceptible to corrosion or rusting.

BRIEF DESCRIPTION OF THE DRAWINGS

The above described advantages of the present invention will become more apparent to those skilled in the art from consideration of the following detailed description of the invention and a study of the drawings in which.

DETAILED DESCRIPTION OF THE PREFERRED EMBODIMENTS

Figure 7:
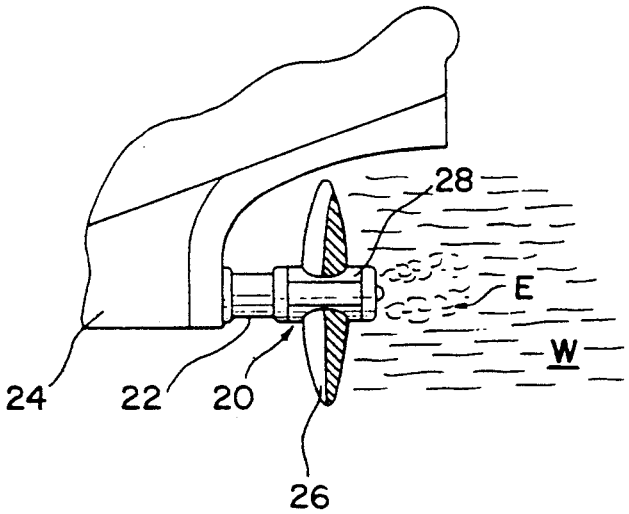
FIG. 7 illustrates the present invention in position with respect to a boat.

FIG. 7 illustrates propeller assembly 20 of the present invention in position on the drive shaft or drive spindle 22 of motor boat 24. As shown in FIG. 7, propeller assembly 20 accelerates water W to the rear of boat 24 causing boat 24 to move forward. Propeller assembly 20 is shown to include a plurality of propeller blades 26 attached to barrel 28. FIG. 7 also illustrates exhaust E being ejected from the rear of barrel 28 following passage through exhausts conduits formed in the barrel.

Figure 1:
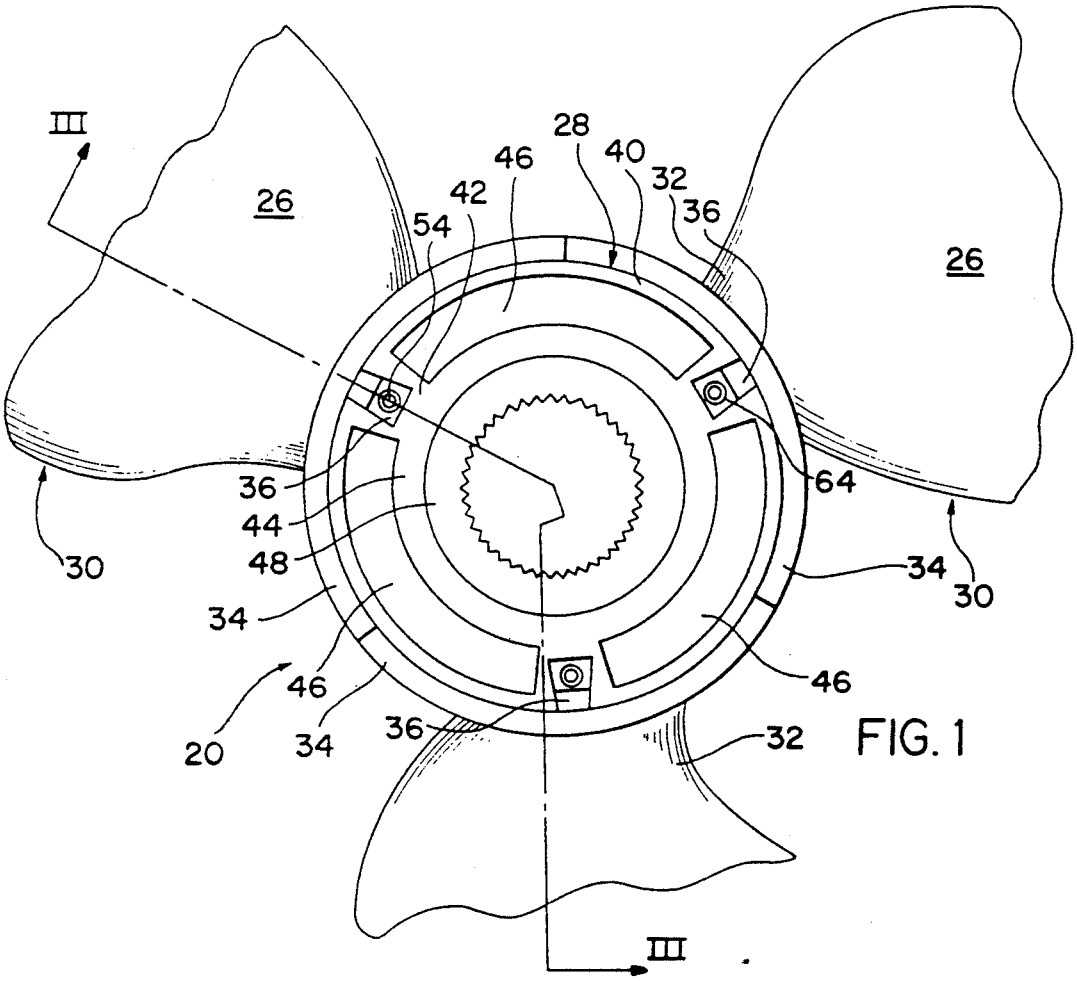
FIG. 1 illustrates a partially cut away elevational view of the aft end of a preferred embodiment of the invention.

FIG. 1 illustrates an aft end view of propeller assembly 20. FIG. 1 illustrates blade assemblies 30 each comprising blade 26 having base 32 which includes flange extension 34. Blade assemblies 30 also each include dovetail shaped locking members 36. FIG. 1 further reveals at reference 38 flange extensions 34 with their side edges in abutting relationship.

FIG. 1 shows locking members 36 extending into slots 50 (FIG. 2) formed in barrel 28. Barrel 28 includes outer shell 40. Outer shell 40 of barrel 28 shares a common curvature with the curved flange extensions 34 and, when locking members 36 are snugly received within the complimentary shaped slots 50, the interior portion of each of flange extensions 34 is in abutting relationship with the exterior of barrel 28.

Figure 2:
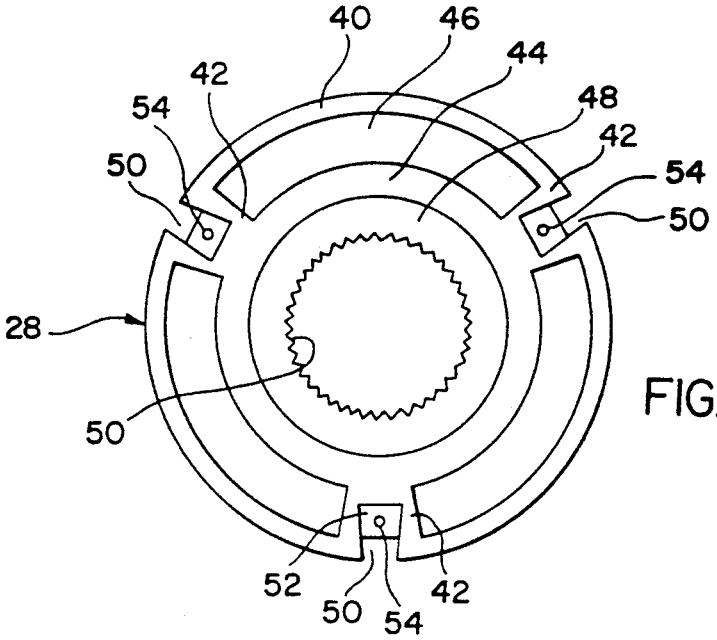
FIG. 2 shows an end view of the embodiment shown in FIG. 1 with the propeller assemblies removed.

FIG. 2 illustrates propeller assembly 20 with blade assemblies 30 removed. As shown in FIG. 1 and FIG. 2, barrel 28 includes spoke members 42 in contact with the interior of outer shell 40 and the exterior of inner shell 44. Spoke members 42 are integrally joined or connected at their ends to inner shell 44 and outer shell 40. Inner shell 44 is preferably concentrically arranged with the cylindrical shaped outer shell 40. Exhaust conduits 46 are defined by adjacent spoke members as well as the exterior of inner shell 44 and the interior of outer shell 40. FIG. 1 and FIG. 2 also illustrate rubber clutch 48 frictionally retained within the confines of inner shell 44. Rubber clutch 48 includes a jagged interior surface 50 which is dimensioned for attachment to drive spindle of the motorized boat's driving means.

FIG. 1 illustrates three blade assemblies 30 connected to barrel 28 as well as an equal number of spoke members 42. In a preferred embodiment of the invention, the number of spoke members equals the number of blade assemblies 30 attached to barrel 28. However, if additional structural rigidity is desired additional spoke members can be utilized such that there are more spoke members than blade assemblies. The number of blade assemblies preferably varies from a minimum of two blades to a maximum of five blades with the flange extensions of each blade circumventing an equal portion of the barrel's exterior such that the flange extensions' side edges are in contact. If individual replacement of the blades is deemed desirable, the abutting side edges of the flange extensions can be retained solely by friction such that each blade assembly can be withdrawn or removed independent of the other blade assemblies. Alternatively, if even quicker withdrawal and replacement of a set of blade assemblies is deemed desirable, the flange extensions can be rigidly secured to one another such as by welding along adjacent side edges whereby the complete set of blade assemblies can be withdrawn and a new set of blade assemblies with a different pitch can be inserted and secured in place. Alternatively, the invention contemplates attaching a unitary casted blade assembly to the barrel. The unitary casted blade assembly includes a continuous ring-like base shared by a plurality of blades. The welding of the blades or formation of a unitary blade assembly also provides additional structural support for when the present invention is used on high horse power driving means (e.g., 400 to 1000 horse power). The securement means of the present invention even without utilizing a welding connection is directed for use with 25 HP to about 400 HP which covers a large range of motors on the market. The above horse power ranges are designed for the combination of an aluminum material barrel with stainless steel blade assemblies attached by the securement means.

Figure 3:
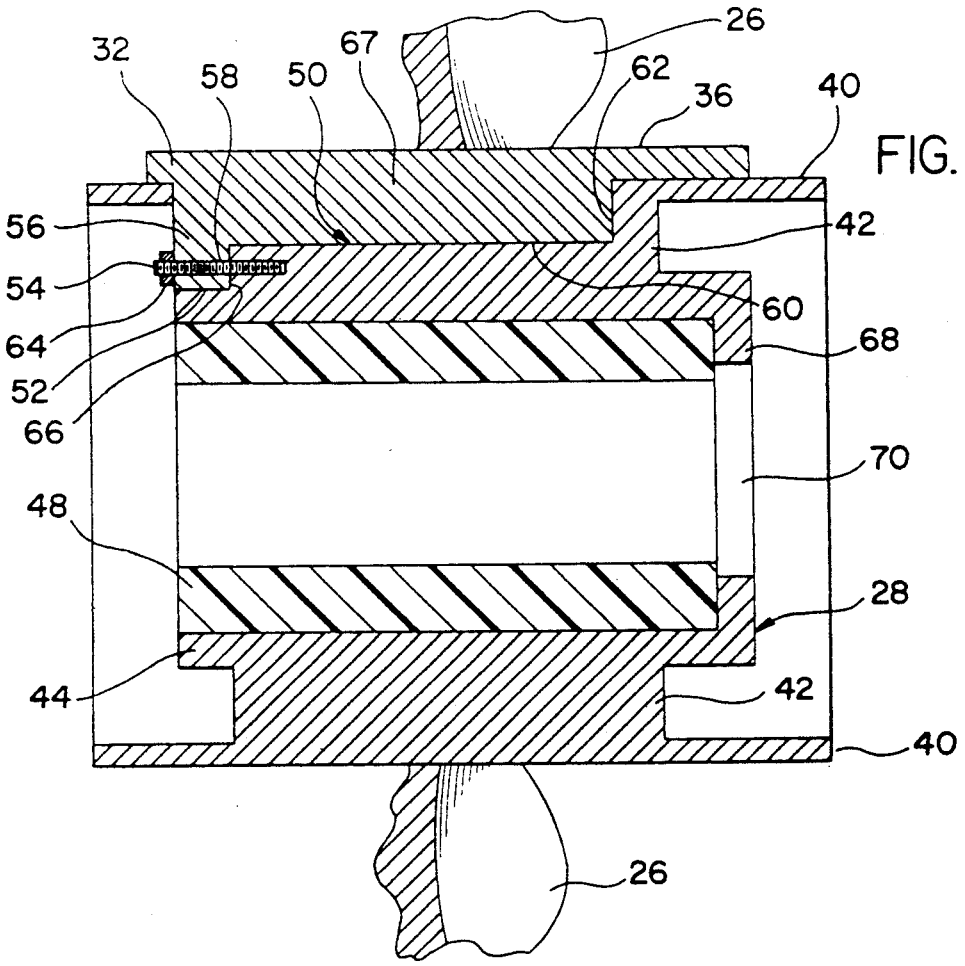
FIG. 3 shows a sectional view taken along section line III—III in FIG. 1.
Figure 5:
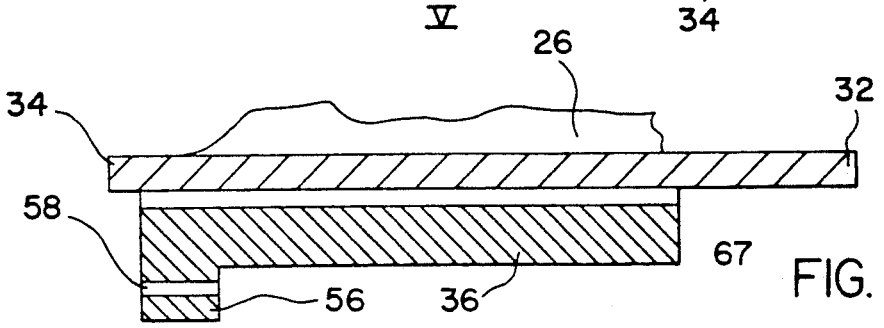
FIG. 5 illustrates a cross sectional view taken along section line V—V in FIG. 4.

FIG. 2 illustrates the dovetail slots 50 formed in spoke members 42 and into which locking members 36 are inserted. As shown in FIG. 2 and more clearly in FIG. 3 a permanent stud 54 extends in a forward to aft direction (i.e., parallel to the longitudinal axis of barrel 28), into and out away from first slot section 52. As illustrated in FIG. 3 and FIG. 5, locking member 36 includes leg member 56 with through-hole passageway 58 formed therein.

FIG. 3 further reveals slot 50 having first slot section 52, second slot section 60, and abutment wall 62. The means for securing locking member 36 within dovetail slot 50 includes the tightening down of nut 64 upon threaded stud 54 such that nut 64 is in contact with leg member 56. The leg member is thus pressed against wall 66 which is defined by first slot section 52. In addition, abutment wall 62 abuts the end of dovetail extension 67. FIG. 3 also reveals barrel 28, which can be formed by casting, having inwardly extending flange 68 with an interior surface defining aperture 70 through which a threaded end of the drive spindle can extend. The drive spindle can be secured to the propeller assembly 20 by any means conventional in the art such as a large nut threaded on the drive spindle and into contact with the inner flange 68.

The present invention also contemplates an alternate securement means embodiment wherein, rather than a permanent stud 54 with locking nut 64, a single threaded bolt is used and received within a threaded bore formed in the barrel.

Barrel 28 of the present invention is preferably formed of aluminum or, more precisely, an aluminum alloy with such a choice of materials being made possible in part by the secure attachment arrangement of the propeller blade to the barrel in the present invention. A preferred aluminum material includes material sold under the trade designation "6061T6" or "413 HT" with the latter having a composition which includes Silicone II (13%); Iron (0.40% max); Copper (0.10% max); Manganese (0.10% max); Magnesium (0.05%); Nickel (0.05%); Zinc (0.10%); Titanium (0.20%); miscellaneous (0.05%) with aluminum constituting the rest of the material. Preferably the aluminum material is an aluminum alloy having 60 to 95% essentially pure aluminum and, more preferably about 85% essentially pure aluminum.

The stud and nut are preferably formed of a stainless steel or similar high strength, rust resistent material. In addition, the preferred material for the blade assembly includes stainless steel with the blade assemblies (or assembly) being formed as a single unit by casting. The use of a stainless steel nut 64, stainless steel stud 54, and stainless steel leg member 56 ensures that the portion of the securement means most prone to being in contact with water (e.g., salt water) is no subject to electrolytic action which can cause corrosion or electrolysis. In other words, by using a separate self-locking stainless steel nut to secure the leg member in place and a stainless steel stud the surfaces in contact and subject to the environment are not prone to electrolysis action and thus will not become frozen or difficult to remove.

Figure 11A:
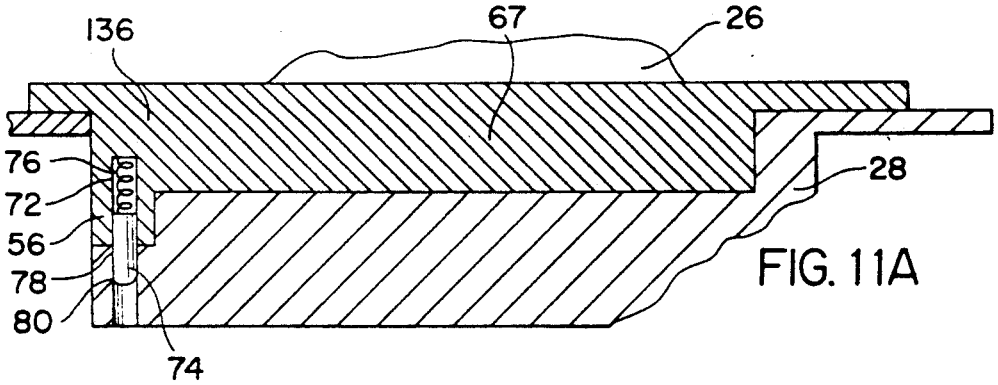
FIG. 11A shows a cross-sectional view of an alternate embodiment of the locking member in the present invention.

FIG. 11A illustrates another embodiment of the present invention wherein locking member 36 has leg member 56 formed with a vertical aperture 72 which receives pin 74 and spring 76 therein. Following a sliding of locking member 36 into slot 50, pin 74 is first biased inwardly as it slides over surface 78 until it is aligned with hole 80 formed in barrel 28 where upon pin 74 is biased into hole 80 by stainless steel spring 76. Thus, locking member 36 as well as the remainder of blade assembly 30 would be locked in place with respect to barrel 28 by the aforementioned means of securing.

Figure 11B:
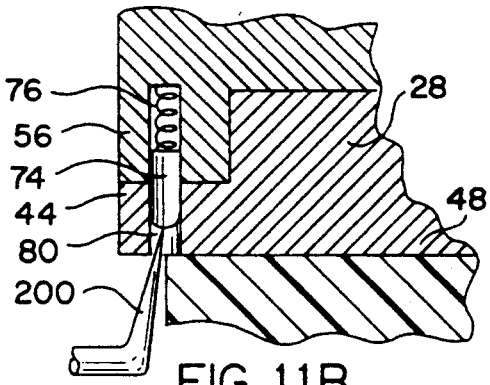
FIG. 11B shows a portion of FIG. 11A in greater detail as well as a tool which can be used to disengage the locking pin from engagement.

FIG. 11B illustrates in more detail the arrangement between rubber clutch 48, barrel 28 and leg member 56. Spring biased pin 74 is shown extending into hole 80 which opens into the interior bore defined by inner shell 44. Rubber clutch 48 is shown not to extend all the way to the end of inner hub 44, but, rather, to have its end placed back away from the end. Preferably the end of rubber clutch 48 is placed midway of hole 80 such that hole 80 is half covered. The half of hole 80 provides an insertion point for tool 200 which is any sharp slender object which can be inserted into the hole so as to push pin 74 upward into a disengaged position. The pin and spring are formed of stainless steel to avoid rusting. This assembly provides for very fast assembly and disassembly. This arrangement is designed for use with motors ranging from 25 to 250 HP.

Figure 4:
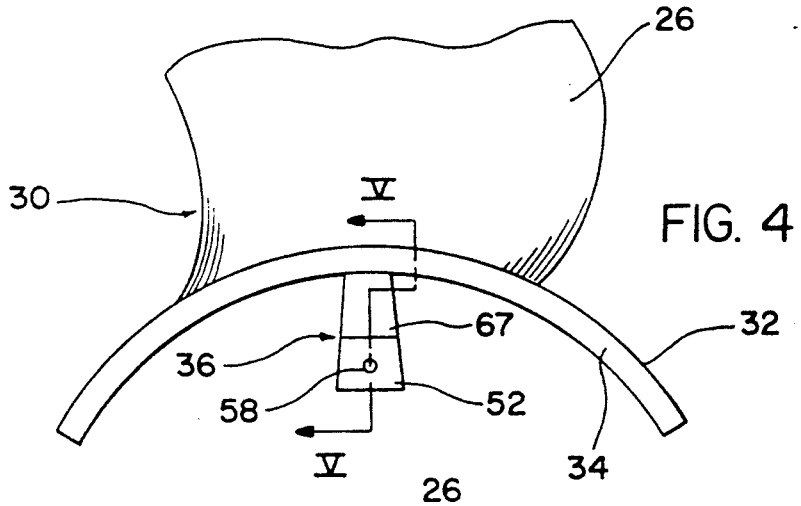
FIG. 4 shows a partially cut away view of the blade assembly shown in FIG. 1.
Figure 6A:
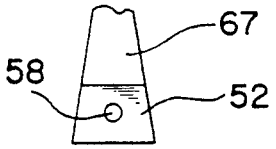
FIG. 6A illustrates an end view of the locking member shown in FIG. 5.

FIG. 4 illustrates a forward end view of blade assembly 30 with locking member 36 extending downwardly from a central portion of the interior surface of flange extension 34. As shown in FIG. 4 and FIG. 6A locking member 36 features dovetail extension 67 with dovetail leg member 52 extending therefrom. Passageway 58 is also illustrated as being formed in the center of leg member 52.

Figure 6B:
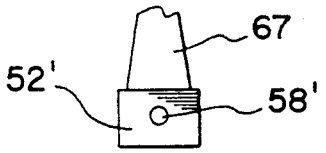
FIG. 6B illustrates an end view of an alternate embodiment of the locking member.

FIG. 6B illustrates modified leg member 52' extending off dovetail section 67. As shown, leg member 52' has a square cross section which would be received in a complimentary shaped recess or first slot section (not shown).

FIG. 5 represents a cut away sectional view taken along section line V—V in FIG. 4. As shown in FIG. 5 and more clearly in FIG. 3, locking member 36 is formed integral with base section 32 of blade 26. Further, as shown in FIG. 3, locking member 36 is shown to extend in a forward to aft direction for about 85% of the forward to aft length of spoke member 42. In a preferred embodiment of the invention, with an aluminum material barrel and a stainless steel blade assembly, the dimensions are as follows:

| | (in inches) |
|---|---|
| 1. blade base thickness | .125 |
| 2. longitudinal (forward-aft) length of blade base | 4.400 |
| 3. barrel outer shell thickness | .125 |
| 4. longitudinal length of dovetail extension (67) | 2.750 |
| 5. longitudinal length of leg member | .375 |
| 6. radial depth of dovetail extension | .500 |
| 7. radial depth of leg member | .765 |
| 8. dovetail taper - width of base | .312 |
| width of top | .200 |
| 9. distance end of inner shell is radially inset with respect to end of outer shell (both ends) | .600 |
| 10. diameter of barrel | 4.300 |
| 11. longitudinal length of outer shell | 5.345 |
| 12. longitudinal length of leg member | 3.125 |
| 13. diameter of aperture (70) | 1.435 |
| 14. internal diameter of inner shell | 2.250 |
| 15. thickness of inner flange (68) | .300 |

-continued

| | (in inches) |
|---|---|
| 16. longitudinal distance form forward end of inner shell to forward end of flange (68) | 3.950 |
| 17. barrel inner shell thickness | .350 |
| 18. length from aft end of base member(32) to aft end of outer shell | .465 |
| 19. length from forward end of outer shell to forward end of base member | .480 |

Figure 9:
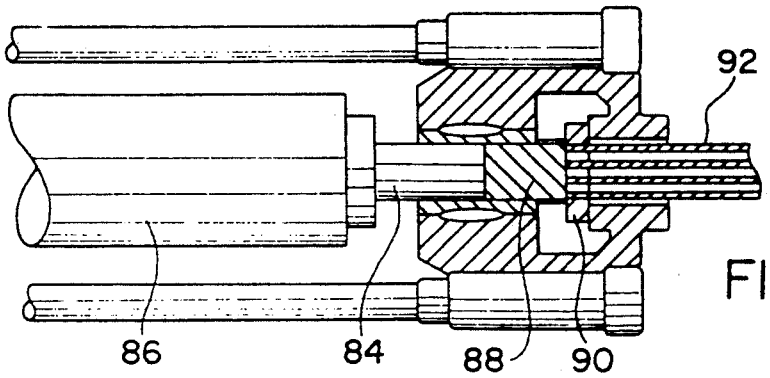
FIG. 9 illustrates an extrusion device suitable for carrying out the manufacturing process of the present invention.
Figure 10:
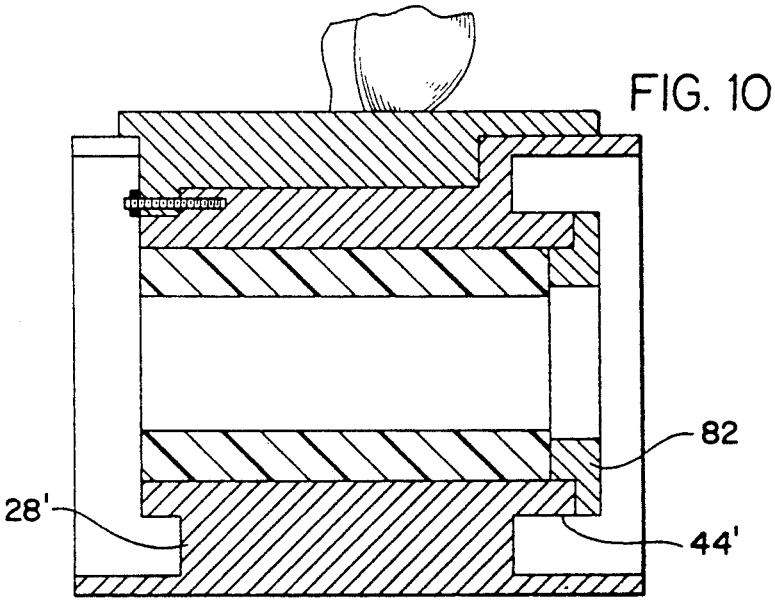
FIG. 10 illustrates an alternate embodiment of the present invention formed, in part, by extrusion.

Referring now to FIGS. 9 and 10, there is illustrated an alternate embodiment of the present invention and an apparatus for manufacturing that alternate embodiment. FIG. 10 illustrates essentially the same propeller assembly 30 as that which was previously described except barrel 28' is formed in an extrusion process which requires threaded end cap 82 as opposed to the integrally formed flange 68 shown in FIG. 3.

FIG. 9 illustrates an extrusion press suitable for forming barrel 28'. As shown in FIG. 9, ram 84 of hydraulic cylinder 86 is placed in contact with billet 88. Billet 88 forms the material from which barrel 28' is to be formed and preferably is a material such as the previously described aluminum material which can be extruded in either a hot or cold extrusion process.

In order to form the inner shell, outer shell, spoke members, exhaust conduits and second slot extensions in a continuous process, an appropriate shaped die 90 (shown schematically) is utilized which preferably includes a spider mandrel for achieving the desired form of barrel 28'.

By forcing billet 88 forward the material comprising billet 88 is squeezed in toothpaste like fashion through the die so as to form continuous extruded barrel 92.

Continuous extruded barrel 92 is then cut into barrel segments each having essentially the length of barrel 28'. These barrel segments are then machined (e.g., milling or electrical discharge machining) so as to include first slot sections. In addition, the interior of the aft end of inner shell 44' is provided with threads which are designed to lockingly receive the threads formed on end cap 82 as shown in FIG. 10.

Figure 8:
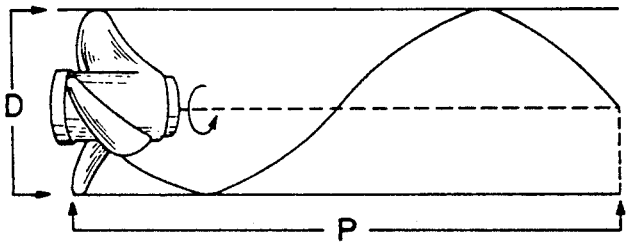
FIG. 8 illustrates the pitch measurement for a particular propeller blade assembly.

FIG. 8 illustrates that propeller pitch P defines the distance that a propeller would advance in one revolution. FIG. 8 further illustrates diameter D of a propeller assembly with right-hand (RH) blades.

Figure 12A:
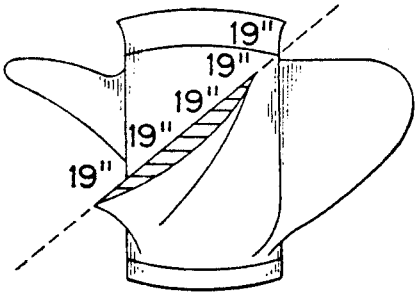
FIG. 12A illustrates a constant pitch right hand propeller blade.
Figure 12B:
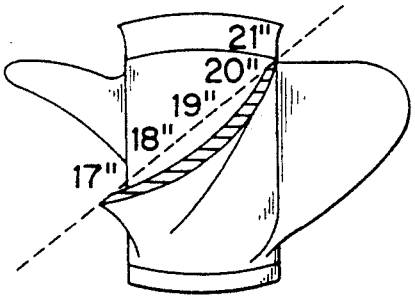
FIG. 12B illustrates a progressive pitch right hand propeller blade.

FIGS. 12A and 12B provide a comparison of the difference between a constant pitch such as 19" and a progressive pitch progressing from 17–21 inches in one inch increments for a RH blade.

Figure 13A:
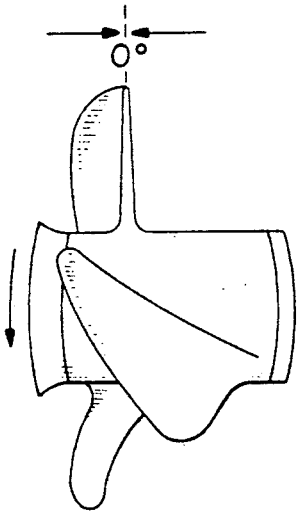
FIG. 13A illustrates a right hand propeller blade with 0° rake.
Figure 13B:
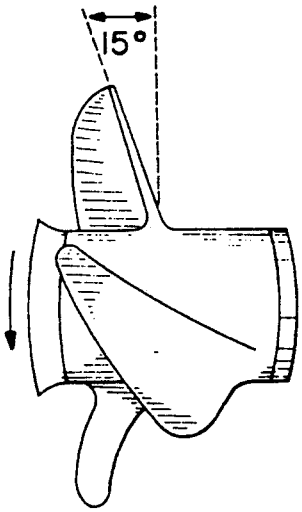
FIG. 13B illustrates a right hand propeller blade with 15° rake.

FIGS. 13A and 13B illustrate a comparison of a 0° rake angle blade and a 15° rake angle blade for a RH or LH blade.

Previously designed twin drive motor boats often rotated the blades in the same direction and relied entirely on RH blades assemblies. This design resulted in boats being subjected to a hazardous amount of tilting and steering being made difficult. In light of these dangers, twin drive motor boat have been designed with one clockwise and one counter clockwise drive shaft with one shaft having a right hand blade and the other having a left hand blade. The present invention provide unique left hand blade designs (preferably formed of aluminum or stainless steel) which are suitable for use with drive motors.

An important feature of these left hand blades is the rake angle which in a preferred embodiment are about 14° to 18° (more preferably 16° to 17°). The preferred constant pitch is about 13 to 28 inches and the preferred progressive pitch falls within the range of about 13 to 28 with about a 1 inch progression to about a 4 inch progression (3.g., 15 to 16 inches for 1 inch progressiveness and 21 to 25 inches for a 4 inch progressiveness)

Figure 15:
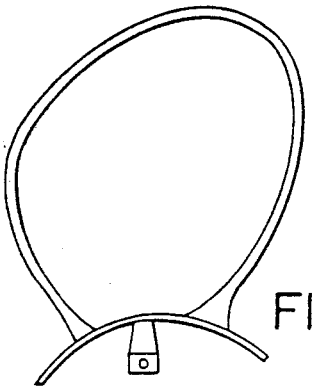
FIG. 15 illustrates a preferred left-hand blade assembly of the present invention.
Figure 14A:
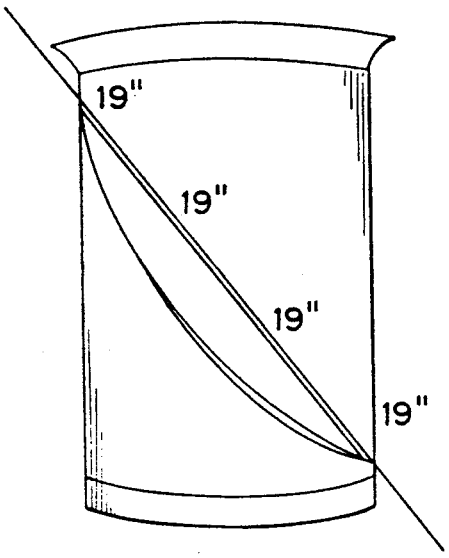
FIG. 14A illustrates a preferred blade of the present invention having a left-hand constant pitch.
Figure 14B:
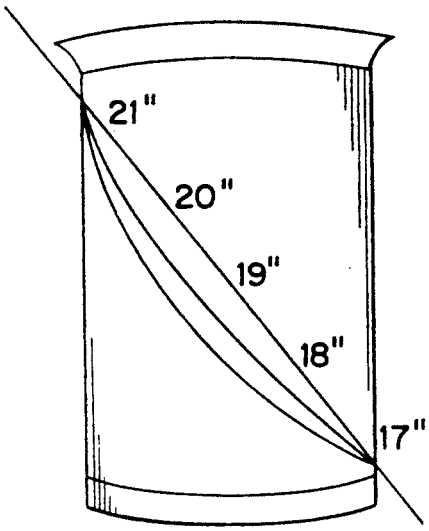
FIG. 14B illustrates a preferred blade of the present invention having a left hand progressive pitch.

FIGS. 14A, 14B and FIG. 15 illustrate preferred left-hand blades of the present invention suitable for use with drive means having left hand drive shaft rotation capabilities.

The discussion below provides the results of experimentation conducted which illustrates the improved strength of the present invention's securement means and its ability to avoid destruction of the blade connection.

The test equipment featured a lathe with a 25 h.p. 480 volt electric motor, 1740 r.p.m. The bar of the lathe to which the propeller assembly was attached, was belt driven through a transmission of various gear ratios. The belt tension of the driven motor was used to vary the feet pounds of torque for each test. Load test was measured in foot pounds of torque.

The blades were placed in contact with a fixed bar until deterioration or excessive distortion resulted. The results of the tests are as follows:

(1) The point of destruction for a unitary cast aluminum propeller assembly was measured at 480 ft-lbs torque.

(2) The point of destruction for an aluminum propeller assembly with the blade secured to the barrel by a tapered flange at either end and a ring nut threaded onto one end of the barrel was measured at 265 ft-lbs torque. The point of destruction was taken as the point where major deteriaration showed at the blade fixing points.

(3) The point of destruction for an aluminum propeller assembly with dovetail connection was measured to be 385 ft-lbs torque. The point of destruction was taken as the point where the propeller began to distort on one side of the dovetail and barrel flange.

(4) The point of deterioration for the blade connected with the present invention's securement means which utilizes a dovetail connection along with a permanent stud extending through the leg member in position was 480 ft-lbs. This value is the same as that for the one piece casting and there did not appear any distortion of the fixing dovetail or leg member.

Although the present invention has been described with reference to preferred embodiments, the invention is not limited to the specific details thereof. Various substitutions and modifications will occur to those of ordinary skill in the art, and all such substitutions and modifications are intended to fall within the spirit and scope of the invention as defined in the appended claims.

What is claimed is:

1. A propeller assembly, comprising a barrel having a forward end and an aft end;

a plurality of blade assemblies with each blade assembly including a blade, a base section, and a locking member, said locking member including a dovetail extension extending in a forward to aft direction and a leg member extending off of said dovetail extension, said barrel further including slots extending in a forward to aft direction with each of said slots having a first slot section dimensioned to receive therein a respective one of said leg members, and a second slot section dimensioned to receive therein a respective one of said dovetail extensions; and securement means for releasably securing said leg members to said barrel while positioned within said first slot sections.

2. A propeller assembly as recited in claim 1, wherein said first slot sections are formed at one end of said slots, said leg members each have a passageway formed therein and said securement means includes a securement member dimensioned so as to extend through the passageway.

3. A propeller assembly as recited in claim 2 wherein said securement member is a bolt threadebly received within a threaded bore formed in said barrel.

4. A propeller assembly as recited in claim 2 wherein said securement member is a stud having a first end fixed within said barrel and a second end extending out away from said barrel, and said securement means further including a nut for releasable securement with said stud so as to releasably lock said locking members in said first slot sections.

5. A propeller assembly as recited in claim 4 wherein said locking member, nut, and stud are formed of stainless steel and said barrel is formed of an aluminum material.

6. A propeller assembly as recited in claim 5 wherein said blade assemblies are formed of an extruded aluminum material.

7. A propeller assembly as recited in claim 5 wherein said barrel includes an outer shell and an inner shell and spoke members extending between said inner and outer shells, said barrel further including exhaust passageways formed between said inner and outer shells and between adjacent pairs of said spoke members.

8. A propeller assembly as recited in claim 1 wherein said barrel is formed of an aluminum material.

9. A propeller assembly as recited in claim 8 wherein said barrel is formed of an extruded aluminum material.

10. A propeller assembly as recited in claim 9 wherein said blade assemblies are formed of stainless steel.

11. A propeller assembly as recited in claim 1 wherein said barrel includes an inner shell and an outer shell and a plurality of spoke members extending between said inner and outer shells, said spoke members being secured to said inner and outer shells and said spoke members extending in a forward to aft direction.

12. A propeller assembly as recited in claim 11 wherein said slots are radially aligned with said spokes.

13. A propeller assembly as recited in claim 11 wherein said barrel includes a plurality of exhaust passageways extending forward to aft between said inner and outer shells.

14. A propeller assembly as recited in claim 1 wherein the base of each of said blade assemblies features a curved flanged extension having a pair of external edges, and said curved flanged sections being dimensioned and arranged such that the external edges of adjacent blade assemblies are in contact with one another when said locking members are received within said slots.

15. A propeller assembly as recited in claim 14 wherein said curved flanged extensions have a curvature essentially equal to that of that exterior of said barrel.

16. A propeller assembly as recited in claim 14 wherein the external edges of adjacent blade assemblies are welded together.

17. A propeller blade assembly as recited in claim 1 wherein said securement means comprises a spring biased pin and said barrel includes a hole dimensioned to receive said spring biased pin when said blade assemblies are secured to said barrel.

18. A propeller assembly as recited in claim 1 further comprising a rubber clutch which has a hardness value less than or equal to about 75 durometer.

19. A propeller assembly as recited in claim 1 wherein said blades are left hand rotation blades with a rake of about 14 degree to 18 degree.

20. A propeller assembly, comprising:

a barrel having a forward and an aft end, said barrel further including a plurality of slots extending in a forward to aft direction with said slots each having a first and a second slot section, said first slot section being of a greater depth than said second slot section, and said first slot section being positioned at one end of said barrel;

a plurality of blade assemblies with each blade assembly including a blade, a base section and a locking member, said locking member including an extension member attached to said base section and extending in a forward to aft direction, said locking member further comprising a leg member extending out away from said base section to a greater distance than said extension member such that said locking member is L-shaped; and means for securing said locking member to said barrel while said leg member is received within said first slot section and said extension member is received within said second slot section.

21. A propeller assembly as recited in claim 20 wherein said second slot section is dimensioned and arranged to substantially retain said locking member from radial movement away from said barrel while allowing for said locking member to freely slide in a forward to aft direction within said slot extension prior to securement of said locking member to said barrel with said securement means.

22. A propeller assembly as recited in claim 20 wherein said barrel includes an exhaust conduit extending through said barrel in a forward to aft direction.

23. A propeller assembly as recited in claim 22 wherein said barrel includes an outer shell and an inner shell concentric with said outer shell, said barrel further including a plurality of spoke members connected with said inner and outer shells and extending in a forward to aft direction so as to define a plurality of exhaust conduits between said spoke sections.

24. A propeller assembly as recited in claim 23 wherein said inner shell includes an inwardly extending flange at the aft end of said inner shell.

25. A propeller assembly as recited in claim 23 wherein said slots are radially aligned with said spoke members.

26. A propeller assembly as recited in claim 25 wherein said securement means includes a plurality of studs with each stud extending in a forward to aft direction through or at least into a respective one of said first slot sections, and said leg members having a passageway therethrough for receiving said stud.

27. A propeller assembly as recited in claim 26 wherein said barrel is formed of aluminum material and said stud is formed of a different material than aluminum which is essentially unable to rust.

28. A propeller assembly as recited in claim 27 wherein said stud is formed of stainless steel.

29. A propeller assembly as recited in claim 28 wherein said blade assemblies are formed of stainless steel.

30. A propeller assembly as recited in claim 20 wherein said barrel is formed of an aluminum material.

31. A propeller assembly as recited in claim 20 wherein said barrel is formed of an extruded material.

32. A propeller assembly as recited in claim 31 wherein said barrel is formed of extruded aluminum material.

33. A propeller assembly as recited in claim 20 wherein said barrel is formed of extruded material and said propeller assembly further comprises an end cap threadibly received on said extruded barrel.

34. A propeller assembly as recited in claim 20 wherein said securing means includes a spring biased pin formed in said leg member and a hole extending through a portion of said barrel below said hole with said hole opening into an interior bore formed in said barrel which is adapted to receive a driving shaft, and said hole providing a location into which a tool can be inserted such that said pin can be disengaged from receipt with said hole and said location member withdrawn.

35. A method for manufacturing a propeller assembly comprising:

extruding a barrel so as to have an internal bore for receiving driving means, an inner shell, an exhaust conduit, an outer shell and a plurality of locking slots formed in a forward to aft direction in said outer shell; and forming a plurality of blade assemblies with locking members dimensioned for receipt within said locking slots formed in said outer shells.

36. The method as recited in claim 35 wherein the slots formed in said barrel are formed so as to be dovetailed and said barrel includes a plurality of exhaust conduits and a plurality of spoke members integral with said inner and outer shell and extending in a forward to aft direction.

37. The method as recited in claim 35 further comprising machining a plurality of recesses at one end of said barrel which extend radially deeper than said locking slots; and providing stud bore holes which extend in a forward to aft direction and open into said recesses.

38. A method as recited in claim 35 further comprising providing an end cap with means for securing to the inner shell of said barrel and extruding said barrel out of an aluminum material.

39. A propeller assembly, comprising:

a barrel formed of an aluminum material and having a plurality of exhaust conduits therethrough;

a blade assembly releasably secured to said barrel and formed of stainless steel;

securement means for releasably securing said barrel to said blade assemblies; and said blade assembly including a plurality of blades extending from a common base and said propeller assembly being formed as a unitary casted member, said common base being ring shaped and said securing means including locking members extending radially inward from an interior surface of said ring-shaped base member, and said aluminum material having greater than 60% of pure aluminum.

40. A propeller assembly as recited in claim 39, wherein said blade assembly includes a plurality of blades extending from a common base and said propeller assembly formed as a unitary casted member and said common base is ring shaped and said securing means includes locking members extending radially inward from an interior surface of said ring-shaped base member and said aluminum material having greater than 60% of pure aluminum.

* * * * *